US007055274B2

(12) United States Patent
Fast et al.

(10) Patent No.: US 7,055,274 B2
(45) Date of Patent: Jun. 6, 2006

(54) SIGN HOLDER

(75) Inventors: Jacob Fast, Boca Raton, FL (US); Ralph Rojas, Miami, FL (US)

(73) Assignee: Fast Industries, Ltd, Fort Lauderdale, FL (US)

( * ) Notice: Subject to any disclaimer, the term of this patent is extended or adjusted under 35 U.S.C. 154(b) by 0 days.

(21) Appl. No.: 10/718,528

(22) Filed: Nov. 24, 2003

(65) Prior Publication Data

US 2004/0255500 A1 Dec. 23, 2004

Related U.S. Application Data

(60) Provisional application No. 60/478,834, filed on Jun. 17, 2003, provisional application No. 60/435,820, filed on Dec. 24, 2002.

(51) Int. Cl.
*G09F 3/18* (2006.01)

(52) U.S. Cl. ..... 40/661.03; 40/124.05; 248/220.41

(58) Field of Classification Search ..... 40/124.05, 40/124.19, 771, 661.03, 6; 248/220.41, 2
See application file for complete search history.

(56) References Cited

U.S. PATENT DOCUMENTS

| | | | | |
|---|---|---|---|---|
| 3,977,109 | A * | 8/1976 | Berry et al. | 40/124.05 |
| 4,485,575 | A | 12/1984 | Fast | |
| 4,531,313 | A | 7/1985 | Fast | |
| 4,625,441 | A | 12/1986 | Fast | |
| 4,704,813 | A | 11/1987 | Fast | |
| 4,713,899 | A | 12/1987 | Fast | |
| 4,917,342 | A | 4/1990 | Fast | |
| 4,995,182 | A | 2/1991 | Fast | |
| 5,458,307 | A | 10/1995 | Gebka | |
| 5,488,793 | A | 2/1996 | Gebka | |
| 5,515,632 | A | 5/1996 | Gebka et al. | |
| 5,682,698 | A | 11/1997 | Bevins | |
| 5,899,011 | A | 5/1999 | Brinkman | |
| 6,105,295 | A | 8/2000 | Brinkman et al. | |
| 6,163,996 | A | 12/2000 | Gebka | |
| 6,266,907 | B1 * | 7/2001 | Matteau et al. | 40/776 |

(Continued)

FOREIGN PATENT DOCUMENTS

FR 2 044 154 2/1971

*Primary Examiner*—Joanne Silbermann
(74) *Attorney, Agent, or Firm*—Jacobson Holman PLLC

(57) ABSTRACT

A sign holder assembly formed by a support member attachable to a supporting surface such as a merchandise-receiving shelf, and a sign carried by the support member. The support member includes a backing member and a hingedly secured, latchable, cover. A cruciform-shaped slit extends through the cover and the sign includes one or more bendable tabs inserted through the slits to be captured in a pocket formed when the cover is latched so as to support a flag generally perpendicularly to the supporting surface. The assembly may be secured to the shelf by "push pins" or the like and an attaching element may integrally incorporate the push pins, may include slots through which the push pins may be engaged in the shelf apertures, may be relatively thin so the push pins may pierce the same, or may include any combination of one or more such securing elements. The sign holder may also be formed with a rearwardly carried angular element adapted to be captured in the label-receiving pocket of a label holder and may be provided with an extension on the angular element enabling the sign holder assembly to be engaged in a C-channel.

46 Claims, 7 Drawing Sheets

U.S. PATENT DOCUMENTS 6,568,112 B1 5/2003 Lowry et al.
6,651,369 B1 * 11/2003 Keating et al. ..... 40/658
6,688,567 B1 * 2/2004 Fast et al. ..... 248/220.41
6,862,826 B1 * 3/2005 Lowry et al. ..... 40/649

* cited by examiner

SIGN HOLDER

This is a complete application claiming benefit of provisional application Ser. No. 60/435,820 filed Dec. 24, 2002 and provisional application Ser. No. 60/478,834 filed Jun. 17, 2003.

BACKGROUND OF THE INVENTION

1. Field of the Invention

This invention relates to merchandising aids, and relates more particularly to a sign holder to be secured to the front edge of a merchandising shelf. The sign holder is adapted to carry a "flag" or sign displaying special information to the consumer regarding products on the shelf, such as identifying a "sale" item or the like.

2. Discussion of the Related Art

Shelves with "C-channels" along the front edge are commonly found in merchandise outlets such as supermarkets, pharmacies and the like, the C-channel being formed with spaced upper and lower opposed lips to provide a convenient means for mounting many different kinds of fit-in articles, such as labels, signs or sign holder which provide information relating to the merchandise displayed on the shelf. Adhesive-backed labels can be secured directly to a supporting surface, such as the side of a warehouse shelf, or even directly on the surface of a C-channel. However, removing such adhesive-backed labels is time consuming and difficult, leaving an unsightly residue build-up. For many applications, therefore, non-adhesive paper or plastic labels are preferred since they can easily be replaced if they become damaged or the product information changes. While such non-adhesive labels can sometimes simply be fitted directly between the lips of the C-channel, more commonly, label holders are provided which have a back or body panel attached in some fashion to the supporting surface, with a transparent cover member flexibly secured along one mating edge to the body panel to define between the front surface of the body panel and the rear surface of the cover member a pocket for removable reception of one or more such information-containing labels:

Label holders are generally provided in elongated sections, perhaps 4' or more in width, and may be secured by adhesive strips or the like to any supporting surface such as the side of a shelving or warehouse unit. However, most applications for such label holders are directly on the front flange or in the C-channel of the front edge of a product display shelf. Various prior art embodiments of such label holders can be seen in commonly assigned U.S. Pat. Nos. 4,713,899, 5,458,307, 5,488,793, 5,515,632, 5,682,698, 5,899,011 and 6,105,295, the disclosures of which are incorporated herein in their entireties by reference.

Some merchandising shelves do not have integral C-channels and have only a downwardly depending or downwardly and forwardly angled front edge or lip terminating in a rearwardly-directed lower flange. Attachment of a label holder to a merchandise shelf devoid of an integral C-channel is problematic. While label holders can be adhesively secured to the depending lip on shelves of this nature, moving or replacing such elements, as with the adhesively-backed labels themselves, is difficult, time consuming and leaves an unsightly residue that is resistant to cleaning. Attempts to avoid the adhesive attachment with various elements fixing the lower portion of the label holder to or around the rearwardly extending flange on the bottom of the shelf have been generally unsuccessful because they cannot retain the body panel in position against the front edge of the shelf when the cover member is tipped forwardly to insert or remove a label from the pocket. Several types of merchandising aids designed to accommodate shelves devoid of C-channels are seen in copending, commonly assigned, application Ser. No. 10/222,775 filed Aug. 19, 2002 (the '775 application) and Ser. No. 10/639,470 filed Aug. 13, 2003 (the '470 application), the disclosures of which are incorporated herein in their entireties by reference.

Oftentimes, in addition to the information provided by the product labels, it is desired to highlight certain information about a particular product or group of products by displaying an enlarged "flag" or sign on the shelf, depending from the portion of the shelf carrying such products, or extending into the aisle at such a location. Different forms of "sign holders" are also well known in the merchandising art, examples of which can be seen in the aforementioned U.S. Pat. No. 5,488,793, as well as commonly assigned U.S. Pat. Nos. 4,485,575, 4,531,313, 4,625,441, 4,704,813, 4,917,342, 4,995,182, 5,682,698, and 6,163,996, the subject matters of which are also incorporated herein in their entireties by reference.

Separate sign holders can simply be positioned on the shelf itself, or juxtaposed to the shelf in the aisle. Yet, such an arrangement may not be stable, can waste valuable product display space, and can even cause damage to consumers. For that reason, as seen in some of the aforementioned patents, such sign holders may be designed to be supported partially or entirely in a C-channel overlying the label holders.

While constructions of this nature are convenient in some respects, significant difficulties are encountered when it is necessary to insert new labels-or to remove or replace labels already carried in the underlying label holder. In order to access the label holder pocket, any and all sign holders secured in front of and, therefore, overlying the label holder must first be removed, and subsequently replaced. This is time consuming, labor intensive, and obviously inefficient, particularly when using elongated label holders that may have multiple sign holders engaged along their length.

Moreover, in some instances, or in respect of some portions of an extended product shelf, it may be desirable to support labels or signs of different configurations on the same merchandising aid, avoiding the need to remove or replace a label or sign holder whenever the nature of the goods, or the information to be presented with respect to the goods, is changed. Merchandising aids in the form of a combination label/sign holder wherein labels can be selectively inserted and removed from the label holder pocket without removing any of the sign holders associated with related products are seen in copending, commonly assigned, U.S. Pat. No. 6,568,112 (the '112 patent), the disclosure of which is also incorporated herein in its entirety by reference. The sign holder of the '112 patent is carried by, and moves with, the cover member avoiding interfering with access to the label holder pocket by providing the front surface of the cover member of the label holder with a pair of sign holder-receiving lip members which can snappingly receive edge portions of a resilient plastic or metal sign holder such as seen in aforementioned U.S. Pat. No. 5,488,793, or the engaging portions of a depending sign holder of the type seen in aforementioned U.S. Pat. Nos. 5,682,698 and 6,163,996, or other such commercially available sign holders.

While, as noted above, sign holders adapted to be supported partially or entirely in a C-channel overlying the label holders engaged therein, such devices often fail to securely hold the flag or sign, particularly when the sign holder is of the type designed to project the flag into an aisle, perpendicular to the front edge of the merchandising shelf, so that information can be presented on both sides of the flag attracting the attention of passers-by moving in either direction in the aisle. Moreover, prior art sign holders of the type described generally require the presence of a C-channel or the like at the front edge of a merchandising shelf for support, and can only be carried by a merchandising shelf devoid of a C-channel adhesively, with the attendant disadvantages noted above in the event the sign holder is to be moved or replaced.

Regardless of the nature of the merchandising shelf, whether it includes a C-channel or not, and whether it is fitted with a label holder and/or a combination label/sign holder such as seen in the '112 patent, it would be desirable to have a simple and inexpensive sign or "flag" holder adapted to be carried directly by a shelf with or without a C-channel and/or by a C-channel integral with the merchandise shelf front edge and/or by the sign holder portion of a combination label/sign holder secured to the merchandise shelf.

SUMMARY OF THE INVENTION

It is a primary object of this invention to provide a sign holder that is simple and inexpensive to manufacture, requiring little or no skill to securely position or readily re-position wherever desired, and adapted to display special information regarding products on a merchandising shelf to consumers passing in either direction along an aisle in front of the shelf.

A further object of this invention is to provide a sign holder of the type described formed of two elements, a support member to be attached directly to the merchandising shelf, a C-channel integral with the merchandising shelf, a label holder carried by the merchandising shelf, or a combination label/sign holder carried by the shelf, and the flag or sign itself. Consistent with this objective, one embodiment of the sign holder includes a support member having portions adapted for engaging in selected apertures commonly formed in the supporting surface of a shelf to secure the support member, and thus the sign holder, to the shelf in a manner similar to that disclosed in the '775 or the '470 application. Another embodiment of the sign holder includes a support member particularly designed for engagement in the lips of a C-channel, whether the same is integrally formed on the front edge of a merchandise shelf or carried by the cover of a combination label/sign holder of the type seen in the '112 patent. A still further embodiment of the sign holder of this invention includes an angular support element adapted to engage within the pocket formed behind the transparent cover of the type of label holder designed for capturing non-adhesive labels, with the same angular element being engageable directly in a C-channel or the sign-holding elements of a combination label/sign holder such as seen in the '112 patent.

Another object of this invention is to provide a sign holder including a molded support member which includes complementary portions interconnected by an integral hinge, with through-slits defined in one of the portions to receive a tab or tabs carried by the flag, with the tab or tabs folded at a right angle with respect to the plane of the flag, following which the complementary portions of the sign member may be snapped together to capture the flag in a pocket formed between them.

A still further object of this invention is to provide several embodiments of sign support members, each of which is adapted to carry a sign or flag which may be a simple sheet-like solid element preprinted or carrying adhesive labels on opposed surfaces to provide desired information to the consumer, or may be formed of transparent hinged elements defining a pocket for receiving paper labels or the like to convey such information.

Other and further objects of the instant invention will become apparent from the ensuing description and claims read in conjunction with the attached drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

Like reference characters refer to like parts throughout the several views of the drawings.

DETAILED DESCRIPTION OF THE PREFERRED EMBODIMENTS

Figure 1:
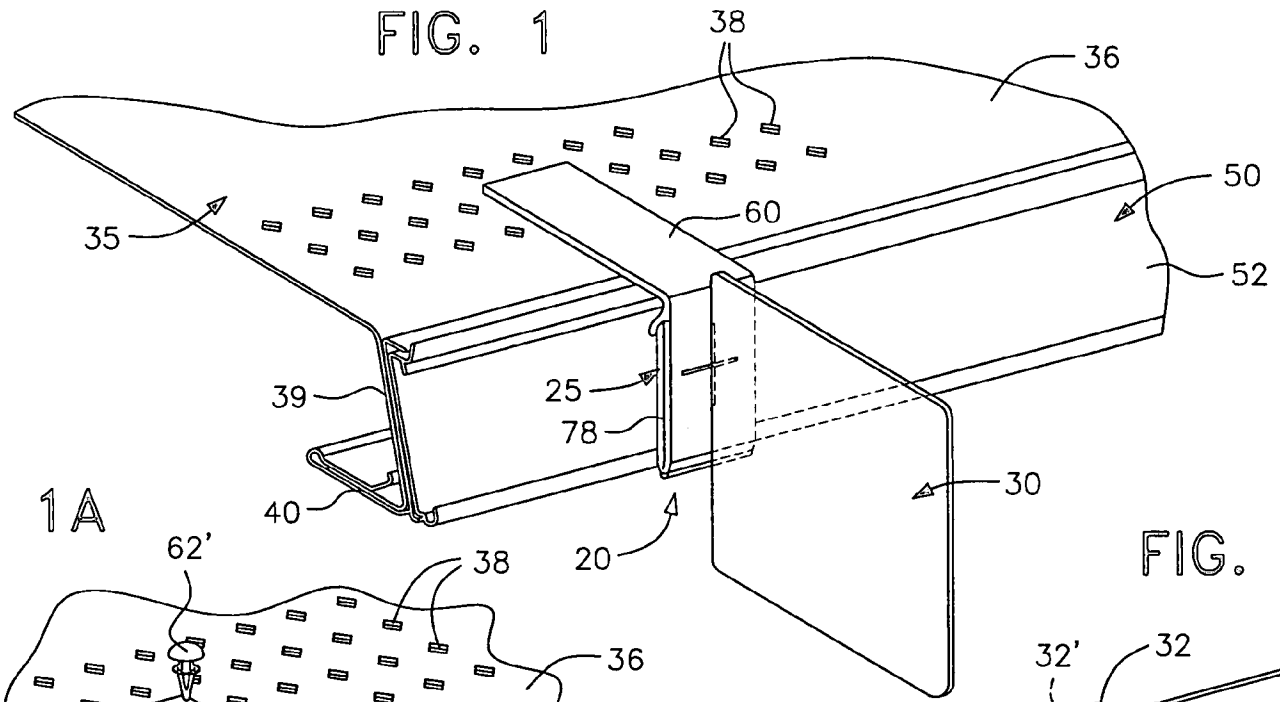
FIG. 1 is a partial perspective view of a merchandising shelf carrying one embodiment of a sign holder according to the instant inventive concepts.

Referring now to the drawings, and more particularly to FIGS. 1–6, one embodiment of a sign holder according to this invention is designated generally by the reference numeral 20 in FIG. 1 and is seen to comprise a support member 25 and a flag or sign 30 carried thereby. The sign holder 20 in FIG. 1 is illustrated as supported on a shelf 35 having an upper, generally horizontally extending, surface 36 with a plurality of apertures 38 defined therethrough, a downwardly and forwardly depending front edge 39 and a rearwardly extending lower flange 40. In FIG. 1, the shelf 35 is illustrated as devoid of an integral C-channel, with a combination label/sign holder 50 of the type discussed generally in the '726 application, adhesively secured or the like to the front edge 39.

It is to be understood that the sign holder 20 of FIG. 1 can be used with a shelf having an integral C-channel formed along its front edge or with a shelf devoid of a C-channel. In the latter event, while the sign holder 20 may be used effectively when the front edge 39 of the shelf 35 is provided with a combination label/sign holder such as shown at 50, the use of a sign holder of the type shown at 20 in FIG. 1 would preclude the advantageous operation of the combination label/sign holder 50 discussed in the '726 application wherein the cover 52 of a combination label/sign holder such as illustrated at 50 can independently carry one or more sign holders and be tipped forwardly to remove or insert a new label without removing the sign holders. Therefore, the embodiment of FIGS. 7–9 discussed below is more effectively used with a combination label/sign holder of this nature.

The sign holder support member 25 is an integrally molded member formed of any conventional polymeric material, such as a semi-opaque polypropylene, and includes a generally planar rear portion 60 which may be formed with one or more integrally molded fasteners such as the "push pin" member 62 adapted to be snappingly engaged in the apertures 38 of the shelf 35 to secure the support member 25 to the shelf 35.

Figure 2:
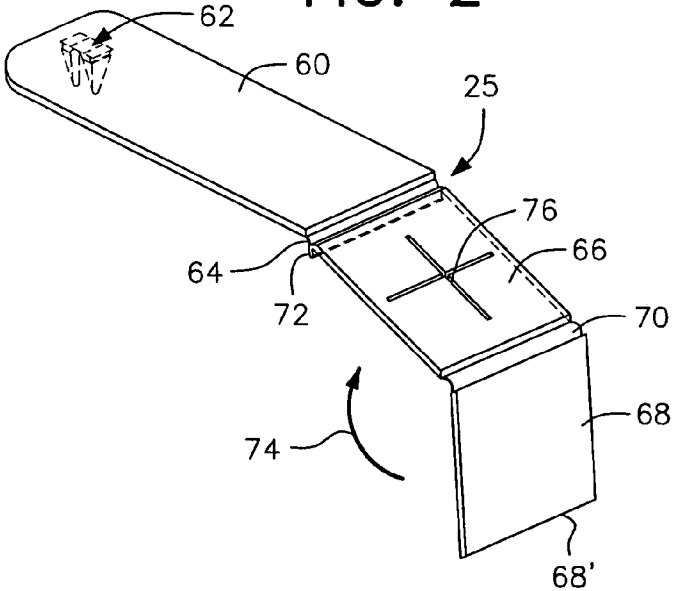
FIG. 2 is a perspective view of the support member of the sign holder of FIG. 1 illustrating the manner in which it is folded to form a pocket for securing portions of a flag or sign during assembly.
Figure 5:
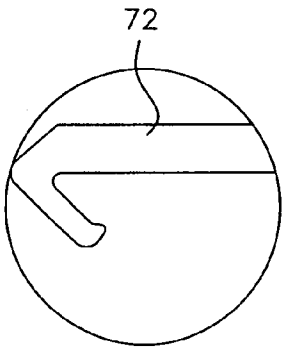
FIG. 5 is an enlarged fragmentary view of the locking flange portion of the support member encircled in FIG. 4.

At the forward end of the planar portion 60, an integral hinge 64 secures elements 66, 68 which are pivotally interconnected to each other at 70, with a locking flange 72 adapted to resiliently secure the terminal edge portions 68' of the element 68 when the same is rotated about the hinge 70 in the direction of the arrow 74 in FIG. 2. The element 66 is provided with cruciform-shaped through-slits 76 which communicates the front face of the element 66 with a pocket 78 formed between the rear surfaces of the elements 66 and 68 when the edge portions 68' of the element 68 is snappingly engaged in the locking flange 72.

Figure 6:
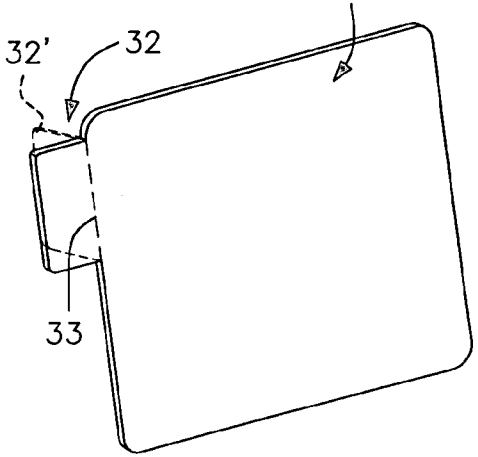
FIG. 6 is a perspective view of a preferred embodiment of a flag or sign to be carried by the support member of the sign holder of this invention.

The flag or sign 30 in the preferred embodiment seen in FIG. 6, includes a tab 32 along one edge as seen in FIG. 6. The flag 30 can be formed of any conventional plastic material as well, and can be pre-printed or adhesively carry labels on one or both faces to attract the attention of passers-by to the merchandise (not shown) carried on the upper surface 36 of the shelf 35.

In use, the tab 32 of the flag 30 is folded 90° along a line 33 which may be weakened during manufacture, to the dotted line position 32' seen in FIG. 6, and inserted into through the slits 76 formed in the element 66 of the support member 25, the element 68 then being folded about the hinge 70 and its edges 68' resiliently captured by the flange 72 to lock the flag 30 in position. The integral fastener 62 can then be snappingly engaged in one of the apertures 38 in the shelf 35 and the weight of the flag 30 will cause the forward portions of the sign holder support member 25 to pivot about the hinge 64 and rest against the front edge 39 of the shelf 35 or a C-channel or label holder or combination label/sign holder such as shown at 50 carried by the front edge 39 of the shelf 35 in the manner seen in FIG. 1.

At any time, the entire sign holder assembly 20 can be readily removed and positioned in another location. Alternatively, the sign 30 can be removed and replaced with a sign carrying other information in an obvious manner.

Figure 1A:
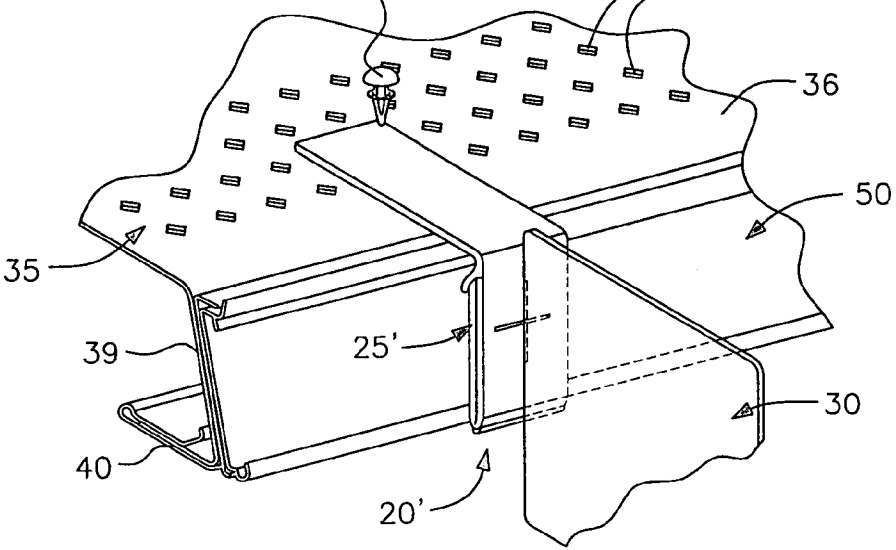
FIG. 1A is a view similar to FIG. 1, but showing a slightly modified form of the sign holder support member.

In FIG. 1A, the modified embodiment of the sign holder support member is designated 25' and is identical with the sign holder support member 25 of the embodiment of FIGS. 1–6, except that the planar portion 60' is a very thin plastic film element formed of a material such as polyvinyl chloride, perhaps on the order of about 0.005" in thickness, and preferably transparent so that the openings 38 of the shelf 35 can be viewed through the film such as disclosed in the '470 application. With such a construction, the film 60' can be easily penetrated by conventional discrete plastic or other such spring-type fasteners, dart clips or push pins 62' to secure the support member 25' to the shelf 35.

Figure 3:
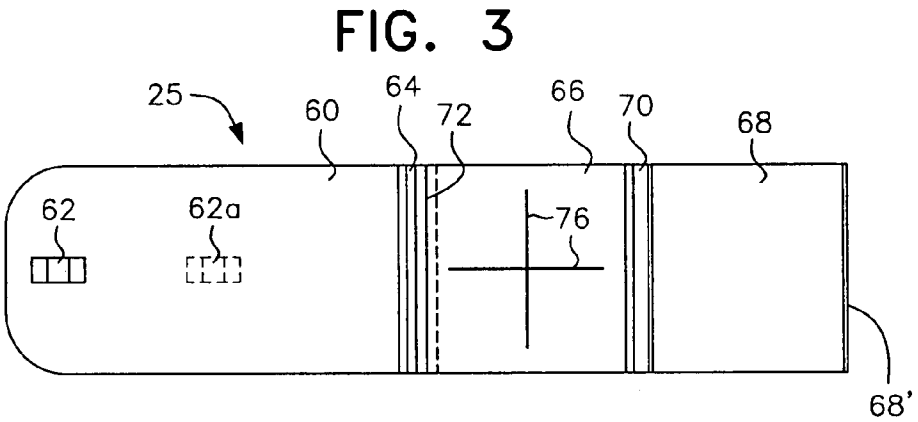
FIG. 3 is a bottom plan view of the sign holder support member of FIG. 2.
Figure 4:
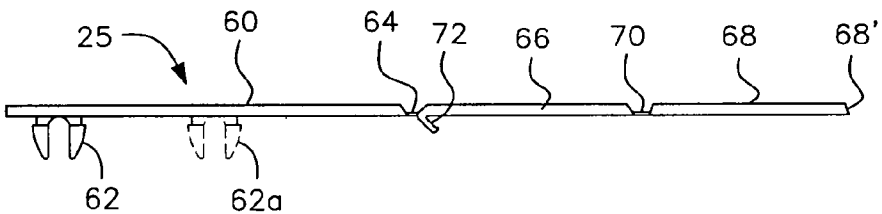
FIG. 4 is a side elevational view of the sign holder support of FIG. 3.

As seen in dotted lines at 62*a* in FIGS. 3 and 4 an additional integral "push pin" can be molded into the planar portion 60 to be engaged in a second aperture 38 in the shelf 39 to preclude rotation of the label holder support member 25 which could occur with only a single point of engagement in the surface 36 of the shelf 39.

Figure 3B:
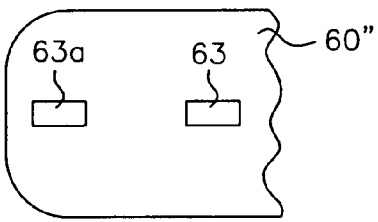
FIG. 3B is a view similar to FIG. 3A showing an embodiment with two slots for reception of discrete "push pins"
Figure 3A:
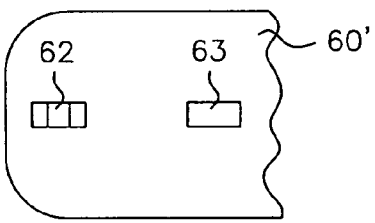
FIG. 3A is a fragmentary bottom plan view of the rear portion of a modified sign holder support including one integral "push pin" and a slot for insertion of a discrete "push pin" of the type seen in FIG. 1A.

Alternatively, as seen in FIG. 3A, the planar portion 60' can be provided with an integral push pin 62 and an elongated through-slot 63 adapted to adjustably receive a discrete push pin such as shown at 62' in FIG. 1A. Moreover, as seen in FIG. 3B, two spaced elongated slots 63 and 63*a* may be formed in the planar portion 60" to provide even greater flexibility in positioning discrete "push pins" in the apertures 38 of the shelf 39.

Figure 7:
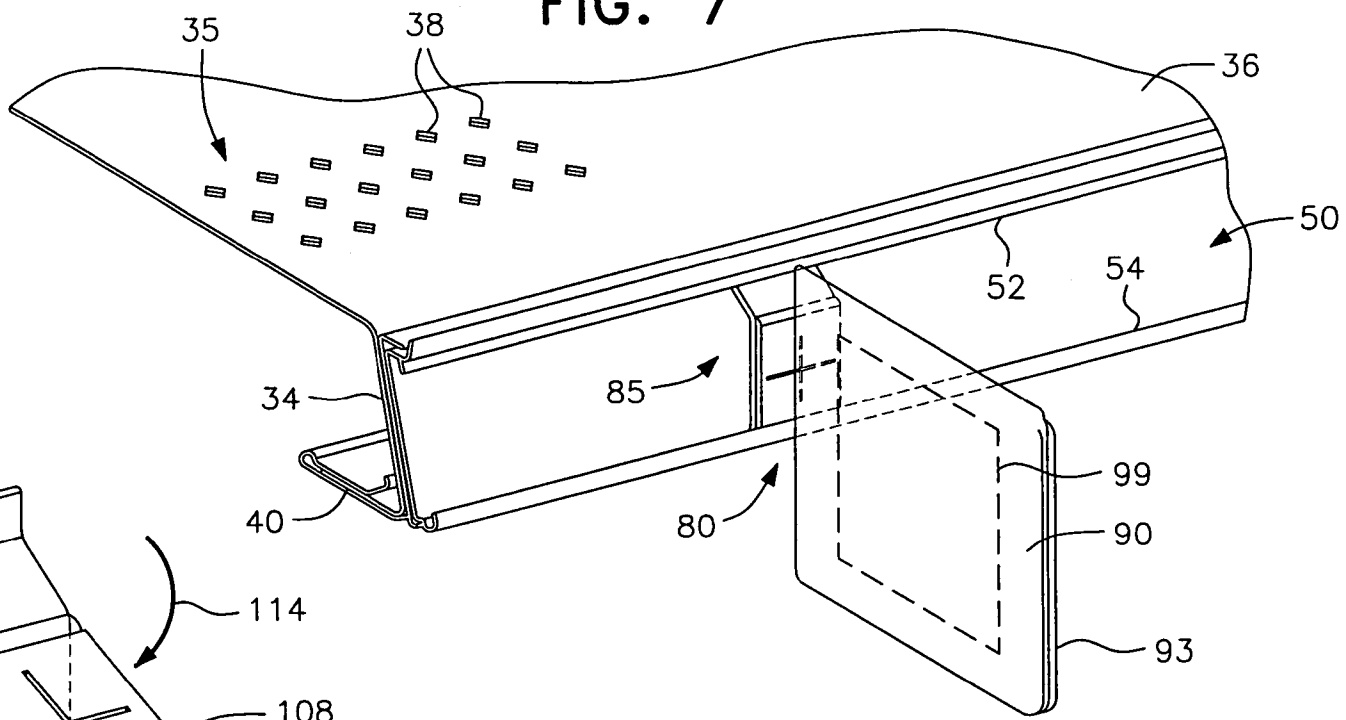
FIG. 7 is a perspective view of a merchandising shelf carrying an alternate form of sign holder according to the instant inventive concepts.
Figure 8:
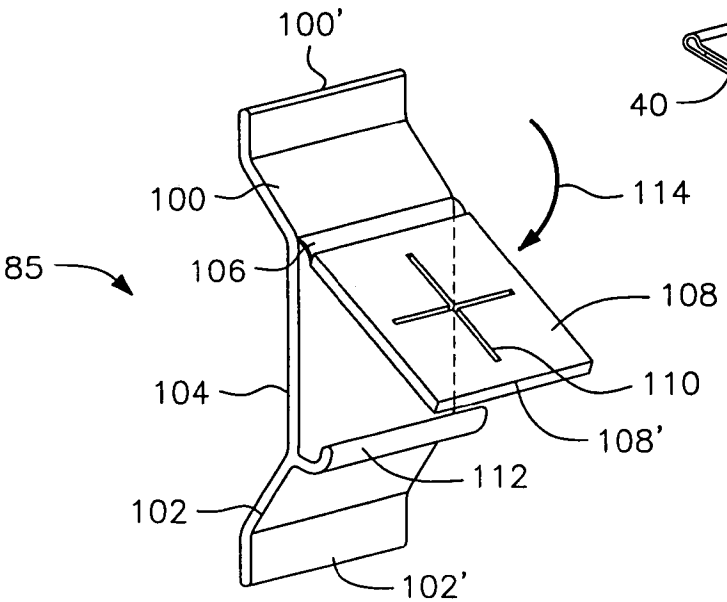
FIG. 8 is a perspective view of the support member of the sign holder embodiment of FIG. 7.

Referring now to FIGS. 7 and 8, a modified sign holder according to this invention, particularly adapted for use in a C-channel integrally formed with a front edge of a shelf or forming part of a combination label/sign holder attached to the shelf, is seen at 80 as comprising a support member 85 and a sign carrying member 90. In this instance, the sign holder support member 85 is a molded element comprising a pair of spring-like end portions 100, 102, interconnected by a intermediate portion 104 hingedly secured at 106 to an element 108 having cruciform-shaped through-slits 110, the edges 108' of the element 108 being engageable in a locking flange 112 when the element 108 is rotated about the hinge 106 in the direction of the arrow 114. The edge portions 100', 102' of the support member 85 can be snappingly engaged in the upper and lower sign holder lips 52, 54 of the combination label/sign holder 50, or comparable lips of an integral C-channel on the front edge 39 of the shelf 35 (not shown).

Figure 9B:
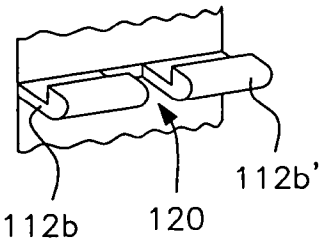
FIG. 9B is a fragmentary perspective view of a further modified latching mechanism according to the invention.
Figure 9:
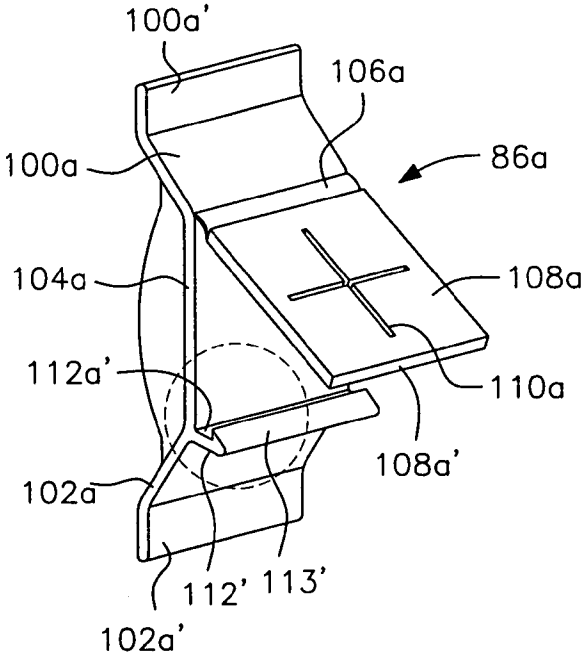
FIG. 9 is a perspective view of a modified sign holder support member similar to FIG. 8, but having a preferred latching mechanism.
Figure 9A:
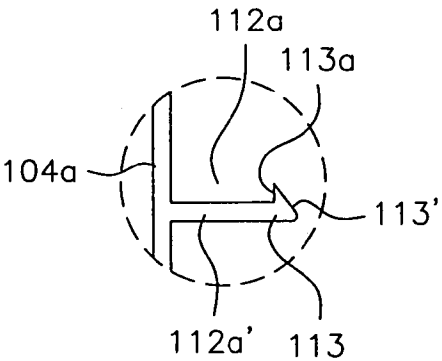
FIG. 9A is an enlarged fragmentary side view of the latching member of the sign holder support member of FIG. 9.

FIGS. 9 and 9A show a modified sign holder support member in which parts similar to those of the embodiment of FIGS. 7 and 8 are designated by the same reference characters followed by the suffix "a". In the support member 85*a*, the locking flange 112*a* includes a perpendicularly extending short leg portion 112*a*' with an upwardly extending angular terminus 113 defining a vertically extending shoulder 113*a*. The angular surface 113' of the terminus 113 facilitates sliding the lower edges 108*a*' of the element 108*a* into locking engagement behind the shoulder 113*a* and affords a more robust and secure locking engagement between these elements.

Figure 10:
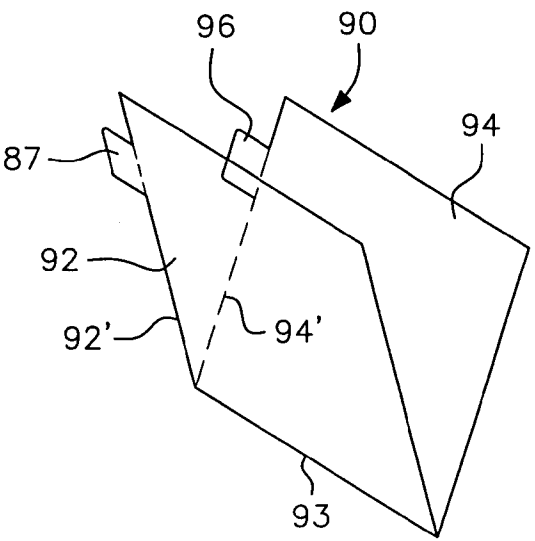
FIG. 10 is a perspective view of an alternate form of a flag or sign carrying member which may be used with a sign holder support member according to any of the embodiments of this invention.

Although a sign carrying element such as shown at 30 in FIG. 6 can be secured to the sign holder support member 85 or 85*a* in a manner similar to that shown in FIGS. 1–6, a sign-carrying member such as illustrated at 90 in FIG. 10 can be formed with a pair of face elements 92, 94, each carrying an integral flap 96, 98, foldable at 90° in opposite outwardly extending directions for insertion into the through-slits 110 or 110*a* in an obvious manner. A sign-carrying member of this nature will preferably be formed of a transparent plastics material, either extruded with an integral hinge at 93 or folded from a sheet material so that the face elements 92, 94 can be folded toward each other to capture a paper label or sign 99 therebetween.

Preferably, the support member incorporates a split locking flange as seen in FIG. 9B, providing a space 120 between the portions 112*b* and 112*b*' to accommodate the edges 92' and 94' of a sign-carrying member such as seen at 90 in FIG. 10 when the sign holder support member is latched with a sign captured thereby.

For most purposes, a flag such as seen at 30 in FIG. 6 and a sign holder support member such as seen at 85 in FIG. 7 or 85' in FIG. 9 will be a preferred combination, although for special applications, particularly when a shelf is devoid of a C-channel, a sign holder support member such as seen at 25 or 25' will be more appropriate and, in specific instances when a paper sign or label is to be displayed, a sign-carrying member of the type seen at 85 or 85*a* can be used with either embodiment of support member.

Figure 11:
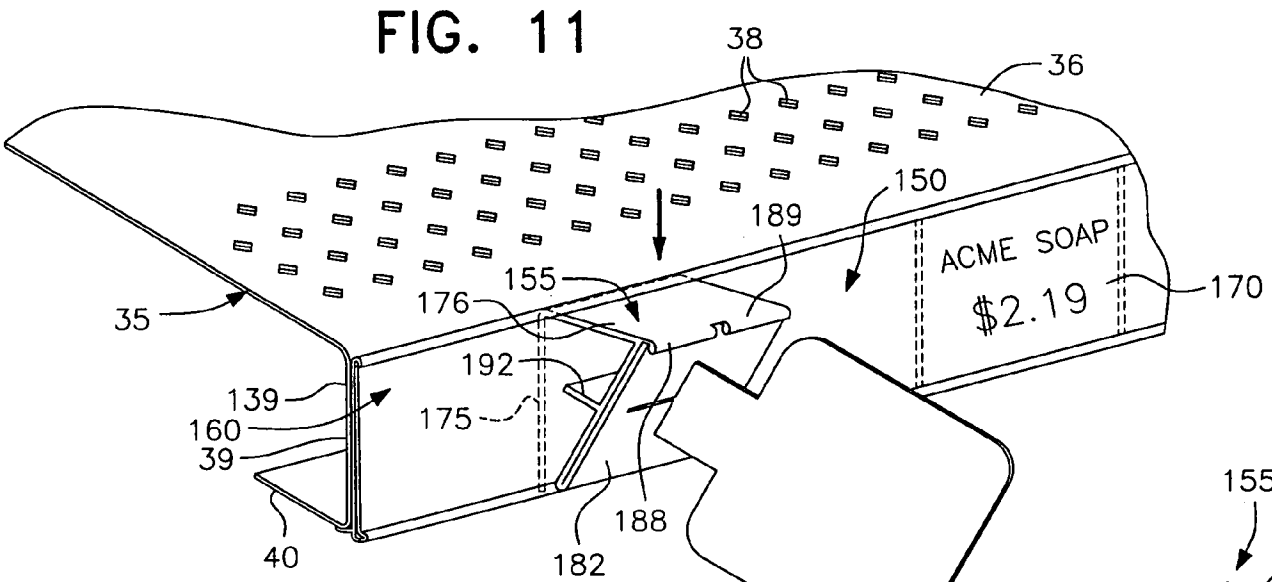
FIG. 11 is a perspective view of a merchandise shelf carrying another modified sign holder according to the instant inventive concepts.
Figure 12:
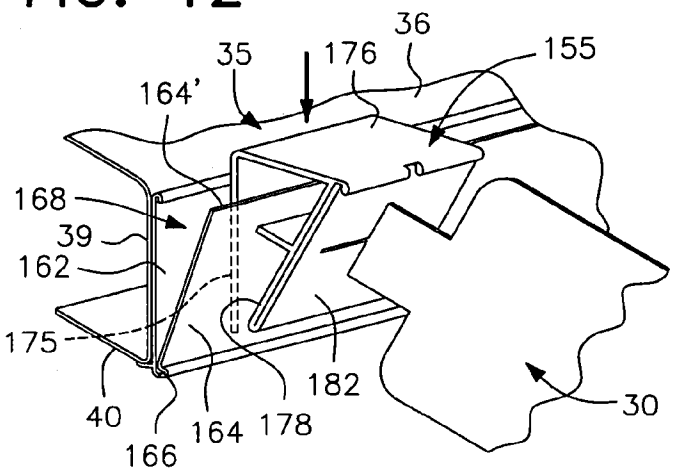
FIG. 12 illustrates the manner in which the slanted or angular support element of the sign holder support member of FIG. 11 can be positioned behind the window of a label holder to secure the sign holder in position.
Figure 13:
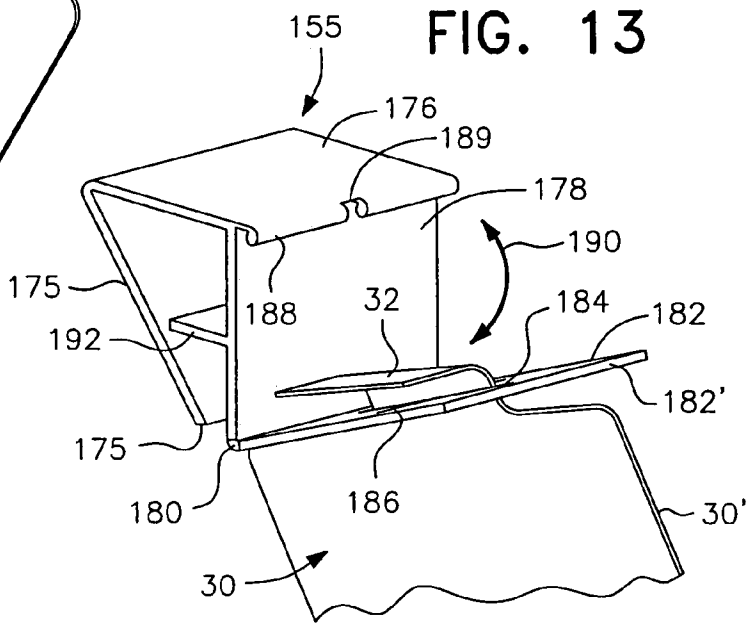
FIG. 13 shows the manner in which the tab of a flag or sign of the type seen in FIG. 6 is inserted through the cross-slits in the cover element of the support member prior to lockingly engaging the same therein.

Referring now to FIGS. 11–13, yet another modified sign holder according to this invention is designated generally by the reference numeral 150 and is seen to comprise a support member 155 and a flag or sign, illustratively shown as the flag or sign 30 of FIG. 6, although, obviously, a sign of the type seen at 90 in FIG. 10 could readily be substituted therefor. The sign holder 150 is illustrated in FIGS. 11–13 as supported on a shelf such as the shelf 35 seen in FIG. 1. In this instance, however, a simple label holder 160 having a backing member 162 is carried by the front lip 39 of the shelf 35 in any conventional manner, with a transparent cover member 164 hingedly secured thereto at their lower edges 166 to form a pocket 168 therebetween adapted to receive non-adhesive labels of the type illustrated at 170 in FIG. 11.

The sign holder support member 155 includes a relatively thin angular element 175 secured to, or integral with, a top element 176 which extends generally horizontally in use and which in turn is secured to, or integral with, a rear element 178 which extends generally vertically in use, perpendicularly to the plane of the flag 30 in the assembled sign holder 150. As in the previous embodiments, an integral hinge 180 interconnects the rear element 178 to a cover element 182 with a pair of cross-slits 184, 186 adapted to receive the foldable tab 32 of the flag 35 as seen in FIG. 13. A locking flange 188 resiliently secures the terminal edge portions 182' of the cover 182 when the same is rotated about the hinge 180 in the direction of the arrow 190. A split or detent 189 in the locking flange 188 accommodates the edge portion 30' of the flag 30 in the assembled relationship of the flag holder 150, if necessary.

As can be seen in FIG. 12, the sign holder support member 155 of the embodiment of FIGS. 11-13 can be used by inserting the angular member 175 over the top edge 164' of the cover member 164 of the label holder 160 to be captured in the pocket 168 of the label holder 160 when the cover member 164 returns to its closed position as seen in FIG. 11.

Figure 14:
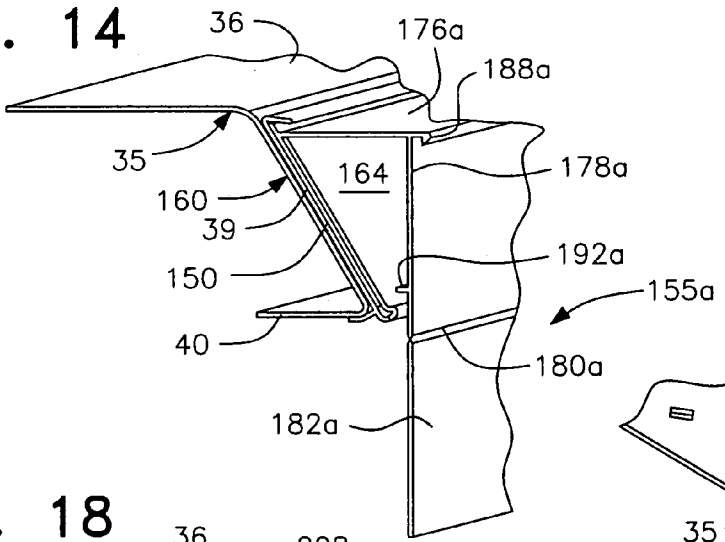
FIG. 14 is a partial perspective view of a slightly modified sign holder support member carried by a conventional label holder prior to engagement of the sign therewith.
Figure 16:
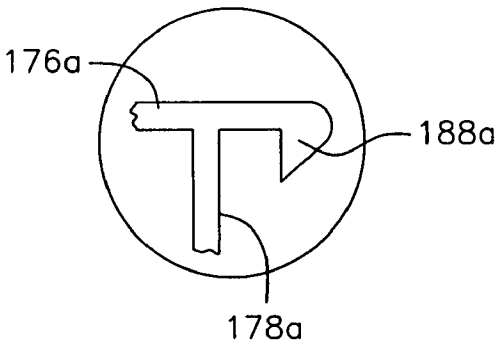
FIG. 16 is an enlarged fragmentary detailed view of the latch portion of the sign holder support member encircled in FIG. 15.
Figure 15:
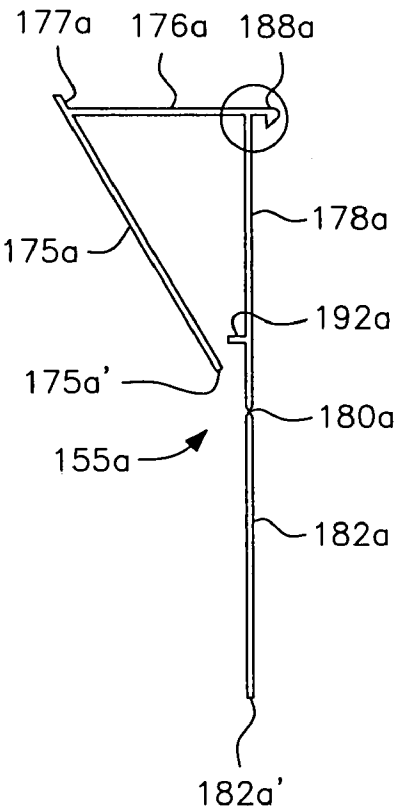
FIG. 15 is a side elevational view of the sign holder support member of FIG. 14.

When engaging the flag receiver sections 178, 182, they are pressed toward the outside of the window or cover 164 of the label holder 160 and are kept in a generally vertical position by a spacer element 192 which extends perpendicularly from the back of the rear element 178. As seen in FIGS. 14–16, wherein parts similar to the embodiment of FIGS. 11–13 are designated by the same reference numerals followed by the suffix "a", the spacer element 192*a* may be moved downwardly relative to the rear element 178*a* to engage the cover member 164 of the label holder 160 at a lower position.

Figure 17:
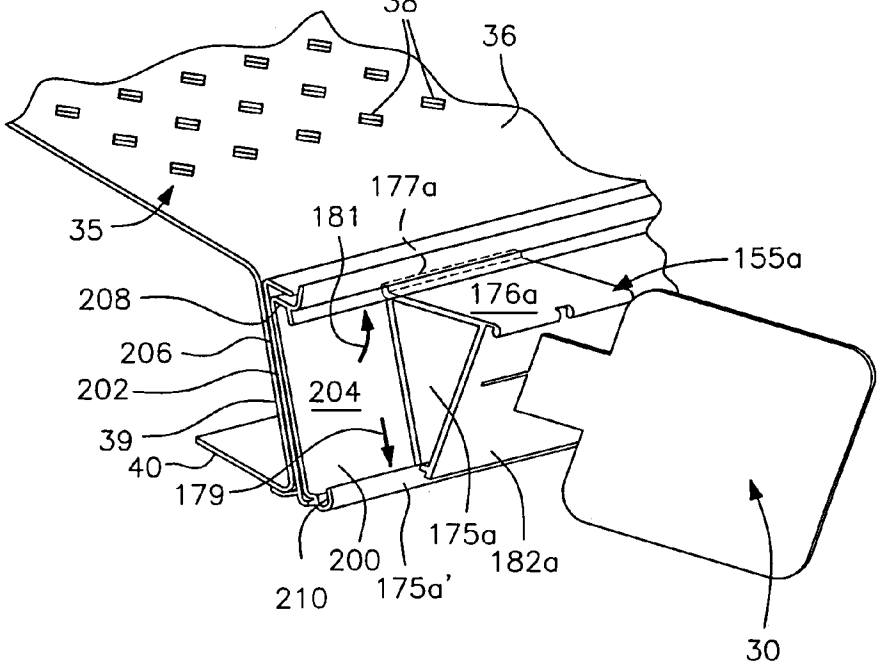
FIG. 17 is a perspective view showing the sign holder support member of FIG. 14 carrying a sign and engaged in the pockets formed by the sign-holder lips of a combination label/sign holder of the type seen in the '112 patent.
Figure 18:
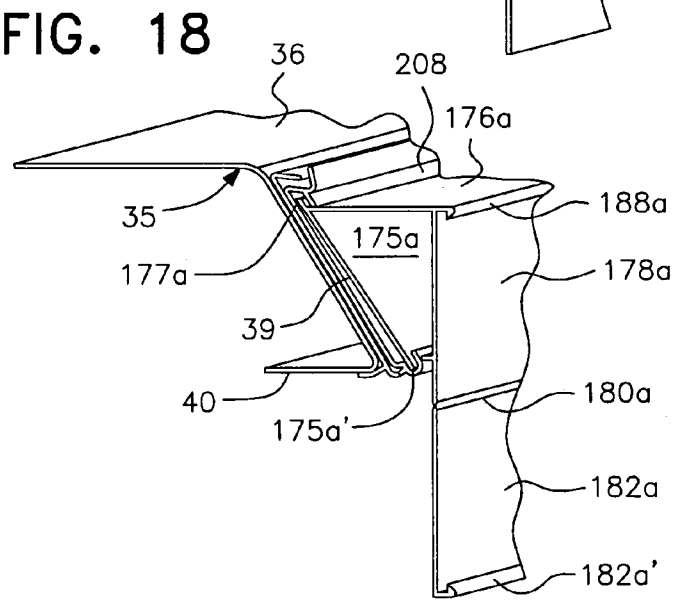
FIG. 18 is a view similar to FIG. 14, but showing the sign holder support member engaged in the pockets of the sign-holder lips of the combination label/sign holder in the manner of FIG. 17.

Referring now to FIGS. 17 and 18, an alternate use of the sign holder support member 155*a* is illustrated, in this instance, in association with a combination label/sign holder 200 of the type seen in FIGS. 1–6 and the '112 patent. With such a construction, rather than engaging the angular element 175*a* in the pocket 202 between the cover 204 and backing element 206 of the combination label/sign holder 200, it is engaged in the pockets formed behind the upper and lower sign-holder lips 208, 210, respectively, of the cover 204. More specifically, the lower edge 175*a*' of the angular element 175*a* is engaged in the pocket formed by the lower sign-holding lip 210 in the direction of the arrow 179 and an extension 177*a* of the angular element 175*a* is engaged in the pocket formed by the upper sign-holding lip 208 of the combination label/sign holder 200 in the direction of the arrow 181.

Although not illustrated, the sign holder support member 155 could be similarly engaged directly in the upper and lower lips of a C-channel formed integrally along the front edge of a merchandising shelf.

The length of the angular element 175*a*, including the extension 177*a*, is designed so that the extension 177*a* will not interfere with the capture of the angular element 175*a* in the pocket 168 of a label holder of the type seen at 160 in FIGS. 11–13, while providing this additional extension 177*a* facilitates engaging the label holder support member 155*a* in the upper lip of a C-channel, whether the same is integrally formed with the merchandising shelf or on the cover of a combination label/sign holder of the type seen in the '112 patent.

Figure 19:
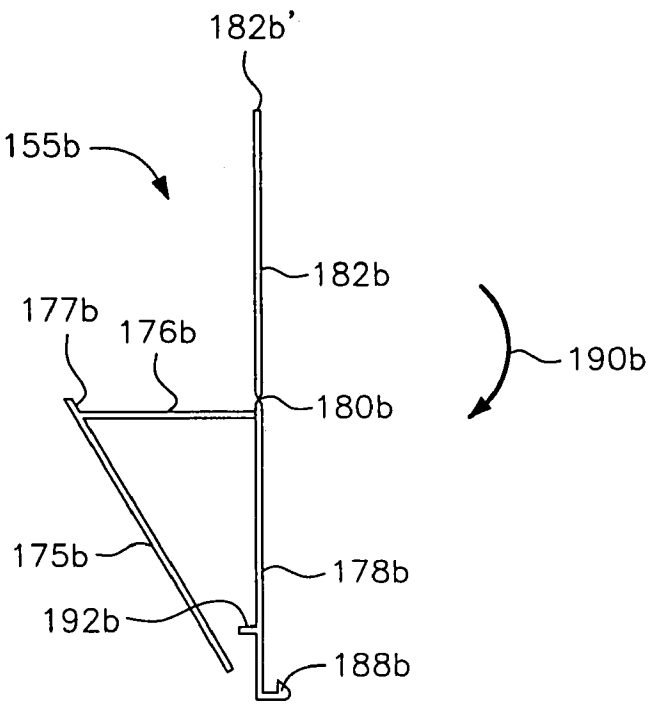
FIG. 19 is a view similar to FIG. 15 of yet another modified sign holder support member with the elements reversed so that the hinge is below, rather than above, the latch.

Additionally, it is to be understood that, although the sign holder support member of this invention can be designed with the locking flange at the top and the hinge at the bottom of the rear element as seen at 188 and 180, respectively, in FIGS. 11–13, this design can be reversed without departing from the instant inventive concepts as seen in FIG. 19, wherein parts similar to the embodiments of FIGS. 11–13 are designated by the same reference numerals followed by the suffix "b". In this embodiment, it can be seen that the locking flange 188*b* is below the hinge 180*b* to capture the edge portions 182*b*' of the cover member 182*b* when the cover member 182*b* is pivoted downwardly as seen by the arrow 190*b* in an obvious manner.

Once again, although not every combination has been illustrated in the drawings, it is to be understood that the various modifications disclosed herein can be used, where practical, with different forms of sign, with different shelf configurations, including those with and without integral C-channels, and different forms of label holder, including combination label/sign holders of the type seen in the '112 patent.

From the foregoing, it will be seen that there is herein provided alternative embodiments of a unique sign holder, simple and inexpensive to manufacture, easy to use, and readily adaptable to securely engage flags or signs of different types with a variety of shelf constructions.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to falling within the scope of the invention.

What is claimed is:

1. A sign holder assembly comprising a support member and a sign to be carried by said support member, said support member comprising a unitary backing member and a cover each having a front face and a rear face, said cover integral with said backing member, said integral backing member and said cover pivotally interconnected by an integral hinge for movement of said cover relative to said backing member between an opened position and a closed position, a latch resiliently securing said cover to said backing member in said closed position to define a sign holder-receiving pocket between said front face of said backing member and said rear face of said cover, an aperture defined through said cover communicating said front face of said cover with said sign holder-receiving pocket, and securing means for attaching said support member to a supporting surface, said sign comprising an element having opposed faces, a tab along one edge of said element extendable at an angle to said faces, said tab being insertable through said aperture in said cover of said support member to be captured in said sign holder-receiving pocket when said cover is latched in said closed position to display said opposed faces of said sign at an angle to the supporting surface.

2. A sign holder assembly according to claim 1 wherein said sign is a planar flag, said opposed faces being on opposite sides of said flag and being adapted to display information regarding merchandise carried by the supporting surface, said tab extending from one edge of said planar element, whereby said tab can be folded at a right angle to said planar element after inserting said tab through said aperture in said cover of said support member, and said cover can be latched to secure said sign to said support member.

3. A sign holder assembly according to claim 1 wherein said sign comprises a pair of transparent elements connected to each other by a flexible hinge to enable said elements to be juxtaposed to define a flag-receiving pocket between their inner faces, each of said elements including a tab extending from juxtaposed edges spaced from said hinge, whereby a flag adapted to display information regarding merchandise carried by the supporting surface can be captured in said flag-receiving pocket, each of said tabs can be folded at oppositely directed right angles to its respective element after inserting said tabs through said aperture in said cover of said support member, and said cover can be latched to secure said sign to said support member.

4. A sign holder assembly according to claim 1 in which said aperture in said cover comprises a slit which extends generally vertically in use so that said flag extends generally perpendicularly to the supporting surface.

5. A sign holder assembly according to claim 4 further including a generally horizontally extending slit crossing said vertically extending slit to facilitate inserting said tab through said cover into said flag-receiving pocket.

6. A sign holder assembly according to claim 1 wherein said latch comprises a latch member resiliently secured at its proximal end to said front face of said backing member and extending perpendicularly therefrom, an upstanding shoulder on the distal end of said latch member to resiliently engage an edge of said cover spaced from said hinge in said closed position of said cover.

7. A sign holder assembly according to claim 6 wherein said latch comprises a pair of latch members resiliently secured to said backing member and defining a slot between them to accommodate edge portions of said sign in said closed position of said cover.

8. A sign holder assembly according to claim 6 further including an angular ramp along said distal edge of said latch member to facilitate engaging said edge of said cover behind said shoulder.

9. A sign holder assembly according to claim 1 wherein said securing means comprising leg members extending from opposing edges of said backing member adapted to be resiliently engaged by a supporting surface.

10. A sign holder assembly according to claim 9 wherein each leg member comprises a proximal portion extending angularly and rearwardly from an edge of said backing member and a distal portion extending generally parallel to said backing member, said distal portion including a terminal edge engageable in a supporting surface.

11. A sign holder assembly according to claim 10 wherein said angular portion of one of said leg members extends from said backing member beyond said hinge connecting said cover to said backing member and said angular portion of the other of said leg members extends from said backing member beyond said latch.

12. A sign holder assembly according to claim 1 wherein said support member further includes a top member having a front edge and a rear edge, said front edge being secured to said rear face of said backing member and said top member extending generally perpendicularly with respect to said rear face, and an angular member having a top edge and a freely-extending bottom edge, said top edge of said angular member being secured to said rear edge of said top member and said angular member extending at an angle downwardly and toward said rear face of said backing member, whereby, if the supporting surface includes a label holder having a body panel hingedly connected to a cover member to define therebetween a label-receiving pocket, said angular member may be captured in the label-receiving pocket to attach said sign holder assembly to the supporting surface.

13. A sign holder assembly according to claim 12 wherein said support member further includes an extension element extending from said angular member beyond the point where said top edge of said angular member is secured to said rear edge of said top member, whereby, if the supporting surface includes a C-channel having an upper lip defining a downwardly opening upper pocket, and a lower lip defining an upwardly opening lower pocket spaced from said upper pocket, said extension element may be engaged in the upper pocket of the C-channel and said bottom edge of said angular member may be engaged in the lower pocket of the C-channel to attach said sign holder assembly to the supporting surface.

14. A sign holder assembly according to claim 1 wherein the supporting surface includes a shelf having a generally horizontally extending portion with an upper surface adapted to carry merchandise for display, the upper surface including a multiplicity of spaced through-apertures and a front edge, and a shelf lip extending downwardly from the front edge of the merchandise-supporting surface, said securing means comprising an attaching element carried by an upper edge of said backing panel at least along a portion of its length, and at least one flexible finger means engageable in at least one aperture in the merchandise-supporting surface of the shelf to secure said attaching element to the shelf.

15. A sign holder assembly according to claim 14 wherein one end of said attaching element is hingedly connected to said upper edge of said backing panel and said flexible finger means is carried by an undersurface of said attaching element.

16. A sign holder assembly according to claim 15 wherein said attaching element is a thin film and said flexible finger means is a push pin or the like adapted to pierce said film and engage in an aperture in the shelf.

17. A sign holder assembly according to claim 15 wherein said flexible finger means is a push pin integrally formed in said undersurface of said attaching element.

18. A sign holder assembly according to claim 14 comprising flexible finger means engageable in a pair of spaced apertures in the merchandise-supporting surface of the shelf.

19. A sign holder assembly according to claim 14 in which at least one flexible finger means comprises a discrete push pin and portions of said attaching member defines a slot through which said push pin can be engaged in a shelf aperture.

20. A sign holder assembly according to claim 19 wherein said slot is elongated to permit said push pin to be slid along its length to align with a shelf aperture.

21. A sign holder assembly according to claim 14 wherein the front surface of the shelf lip is generally planar and said rear surface of said backing member is adapted to rest against the front surface of the shelf lip in use.

22. A sign holder assembly according to claim 21 wherein the front surface of the shelf lip extends at an angle forwardly and downwardly between the front edge of the merchandise-supporting surface and a lower edge of the shelf lip.

23. A sign holder assembly according to claim 14 wherein the shelf lip defines a C-channel and a lower edge of said backing member is engageable in a lower lip of the C-channel.

24. In combination, a supporting surface and a sign holder assembly, said sign holder assembly comprising a support member and a sign to be carried by said support member, said support member comprising a unitary backing member and a cover each having a front face and a rear face, said cover integral with said backing member, said integral backing member and said cover pivotally interconnected by an integral hinge for movement of said cover relative to said backing member between an opened position and a closed position, a latch resiliently securing said cover to said backing member in said closed position to define a sign holder-receiving pocket between said front face of said backing member and said rear face of said cover, an aperture defined through said cover communicating said front face of said cover with said sign holder-receiving pocket, and securing means attaching said support member to a supporting surface, said sign comprising an element having opposed faces, a tab along one edge of said element extendable at an angle to said faces, said tab being inserted through said aperture in said cover of said support member to be captured in said sign holder-receiving pocket with said cover latched in said closed position to display said opposed faces of said sign at an angle to said supporting surface.

25. The combination of claim 24 wherein said sign is a planar flag, said opposed faces being on opposite sides of said flag and displaying information regarding merchandise carried by said supporting surface, said tab extending from one edge of said planar element and inserted through said aperture in said cover of said support member and folded at a right angle to said planar element, and said cover being latched to secure said sign to said support member.

26. The combination of claim 24 wherein said sign comprises a pair of transparent elements connected to each other by a flexible hinge to enable said elements to be juxtaposed to define a flag-receiving pocket between their inner faces, each of said elements including a tab extending from juxtaposed edges spaced from said hinge, a flag displaying information regarding merchandise carried by said supporting surface being captured in said flag-receiving pocket, each of said tabs being inserted through said aperture in said cover of said sign holder and folded at oppositely directed right angles to its respective element, and said cover being latched to secure said sign holder to said base member.

27. The combination of claim 24 wherein said aperture in said cover comprises a slit which extends generally vertically whereby said flag extends generally perpendicularly to said supporting surface.

28. The combination of claim 27 further including a generally horizontally extending slit crossing said vertically extending slit to facilitate inserting said tab through said cover into said flag-receiving pocket.

29. The combination of claim 24 wherein said latch comprises a latch member resiliently secured at its proximal end to said front face of said backing member and extending perpendicularly therefrom, an upstanding shoulder on the distal end of said latch member resiliently engaging an edge of said cover spaced from said hinge in said closed position of said cover.

30. The combination of claim 29 wherein said latch comprises a pair of latch members resiliently secured to said backing member and defining a slot between them to accommodate edge portions of said sign in said closed position of said cover.

31. The combination of claim 29 further including an angular ramp along said distal edge of said latch member to facilitate engaging said edge of said cover behind said shoulder.

32. The combination of claim 24 wherein said supporting surface includes a C-channel having an upper lip defining a downwardly opening pocket and a lower lip defining an upwardly opening pocket, said securing means comprising a leg member extending from opposing edges of said backing member resiliently engaged in said pockets behind said upper and lower lips of said C-channel.

33. The combination of claim 32 wherein each leg member comprises a proximal portion extending angularly and rearwardly from an edge of said backing member and a distal portion extending generally parallel to said backing member, said distal portion including a terminal edge engaged in a pocket defined by one of said lips of said C-channel.

34. The combination of claim 33 wherein said angular portion of one of said leg members extends from said backing member beyond said hinge connecting said cover to said backing member, and said angular portion of the other of said leg members extends from said backing member beyond said latch.

35. The combination of claim 24 wherein said support member further includes a top member having a front edge and a rear edge, said front edge being secured to said rear face of said backing member and said top member extending generally perpendicularly with respect to said rear face, and an angular member having a top edge and a freely-extending bottom edge, said top edge of said angular member being secured to said rear edge of said top member and said angular member extending at an angle downwardly and toward said rear face of said backing member, said supporting surface including a label holder having a body panel hingedly connected to a cover member to define therebetween a label-receiving pocket, said angular member being captured in said label-receiving pocket to attach said sign holder assembly to said supporting surface.

36. The combination of claim 24 wherein said support member further includes a top member having a front edge and a rear edge, said front edge being secured to said rear face of said backing member and said top member extending generally perpendicularly with respect to said rear face, and an angular member having a top edge and a freely-extending bottom edge, said top edge of said angular member being secured to said rear edge of said top member and said angular member extending at an angle downwardly and toward said rear face of said backing member, an extension element extending from said angular member beyond the point where said top edge of said angular member is secured to said rear edge of said top member, said supporting surface including a C-channel having an upper lip defining a downwardly opening upper pocket, and a lower lip defining an upwardly opening lower pocket spaced from said upper pocket, said extension element being engaged in said upper pocket of said C-channel and said bottom edge of said angular member being engaged in said lower pocket of said C-channel to attach said sign holder assembly to said supporting surface.

37. The combination of claim 24 wherein said supporting surface includes a shelf having a generally horizontally extending portion with an upper surface adapted to carry merchandise for display, said upper surface including a multiplicity of spaced through-apertures and a front edge, and a shelf lip extending downwardly from said front edge of said merchandise-supporting surface, said securing means comprising an attaching element carried by an upper edge of said backing panel at least along a portion of its length, and at least one flexible finger means securing said attaching element in at least one aperture in said merchandise-supporting surface of the shelf.

38. The combination of claim 37 wherein one end of said attaching element is hingedly connected to said upper edge of said backing member and said flexible finger means is carried by an undersurface of said attaching element.

39. The combination of claim 38 wherein said flexible finger means is a push pin integrally formed in said undersurface of said attaching element.

40. The combination of claim 37 wherein said attaching element is a thin film and said flexible finger means is a push pin or the like piercing said film and engaged in said aperture.

41. The combination of claim 37 comprising flexible finger means engaged in a pair of spaced apertures in the merchandise-supporting surface of the shelf.

42. The combination of claim 37 in which at least one flexible finger means comprises a discrete push pin and portions of said attaching member define a slot, said push pin being engaged through said slot into said shelf aperture.

43. The combination of claim 42 wherein said slot is elongated to permit said push pin to be slid along its length to align with a shelf aperture.

44. The combination of claim 37 wherein said front surface of said shelf lip is generally planar and said rear surface of said backing member rests against said front surface of said shelf lip.

45. The combination of claim 44 wherein said front surface of said shelf lip extends at an angle forwardly and downwardly between said front edge of said merchandise-supporting surface and a lower edge of said shelf lip.

46. The combination of claim 37 wherein said shelf lip defines a C-channel and a lower edge of said backing member is engaged in a lower lip of said C-channel.

* * * * *